US009098018B2

(12) United States Patent
Kashimoto et al.

(10) Patent No.: US 9,098,018 B2
(45) Date of Patent: Aug. 4, 2015

(54) DEVELOPING DEVICE AND IMAGE FORMING APPARATUS PROVIDED THEREWITH

(71) Applicant: KYOCERA Document Solutions Inc., Osaka (JP)

(72) Inventors: Masahiro Kashimoto, Osaka (JP); Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/519,864

(22) Filed: Oct. 21, 2014

(65) Prior Publication Data

US 2015/0132027 A1 May 14, 2015

(30) Foreign Application Priority Data

Nov. 11, 2013 (JP) ..... 2013-233147

(51) Int. Cl.
*G03G 15/08* (2006.01)

(52) U.S. Cl.
CPC ..... *G03G 15/0891* (2013.01); *G03G 15/0812* (2013.01); *G03G 15/0839* (2013.01); *G03G 15/0889* (2013.01); *G03G 2215/0819* (2013.01); *G03G 2215/0822* (2013.01); *G03G 2215/0827* (2013.01); *G03G 2215/0833* (2013.01)

(58) Field of Classification Search
CPC ..... G03G 15/0839; G03G 15/0889; G03G 15/0891; G03G 2215/0819; G03G 2215/0822; G03G 2215/0827; G03G 2215/0833; G03G 15/0812
See application file for complete search history.

(56) References Cited

U.S. PATENT DOCUMENTS

| | | | | |
|---|---|---|---|---|
| 2007/0269235 | A1* | 11/2007 | Hirose | 399/254 |
| 2009/0180812 | A1* | 7/2009 | Kunihiro | 399/254 |
| 2009/0245879 | A1* | 10/2009 | Minami et al. | 399/255 |
| 2011/0150537 | A1* | 6/2011 | Watanabe et al. | 399/256 |
| 2011/0222914 | A1* | 9/2011 | Yoshihara | 399/258 |
| 2011/0229213 | A1* | 9/2011 | Mihara et al. | 399/263 |
| 2013/0216257 | A1* | 8/2013 | Fujimura et al. | 399/103 |

FOREIGN PATENT DOCUMENTS

JP 2011-128518 A 6/2011

* cited by examiner

*Primary Examiner* — Ryan Walsh
(74) *Attorney, Agent, or Firm* — Stein IP, LLC

(57) ABSTRACT

A developing device according to the present disclosure is provided with a developing container, a first stirring conveyance member and a second stirring conveyance member that stir and convey a developer within the developing container, and a developer carrying member that carries the developer. The developing container includes a discharge passage where a developer discharge port for discharging surplus developer within the developing container is formed. In the discharge passage, a discharge screw having a rotation shaft and a spiral blade is disposed. Within the discharge passage, at a portion on an upstream side of the developer discharge port in a developer discharge direction, there is provided a discharge regulating member that regulates discharge of the developer.

13 Claims, 7 Drawing Sheets

DEVELOPING DEVICE AND IMAGE FORMING APPARATUS PROVIDED THEREWITH

INCORPORATION BY REFERENCE

This application is based upon and claims the benefit of priority from the corresponding Japanese Patent Application No. 2013-233147 filed on Nov. 11, 2013, the entire contents of which are incorporated herein by reference.

BACKGROUND OF THE INVENTION

The present disclosure relates to a developing device and an image forming apparatus provided with the same, and in particular relates to a developing device including a discharge passage where a developer discharge port for discharging developer is formed, and an image forming apparatus provided with the same.

In image forming apparatuses, a latent image formed on an image carrier constituted by a photosensitive member and the like is developed by a developing device to be visualized as a toner image. Examples of the developing device include one employing a two-component developing method in which a two-component developer is used. The developing device of this type includes a developing container, in which a two-component developer including a toner and a carrier is stored, and there are arranged a developing roller that supplies the developer to the image carrier and a stirring member that supplies the developer in the developing container to the developing roller while stirring and conveying the developer.

In the developing device employing the two-component developing method, the toner is consumed through developing operations, while the carrier circulates in the developing device without being consumed, and deteriorates with time. As a result, charging performance of the carrier with respect to the toner is gradually degraded.

As a solution to this problem, there has been known a method for preventing deterioration of the charging performance of the carrier, and such a method is embodied in, for example, a developing device in which deterioration of the charging performance of the carrier is reduced by supplying fresh developer including fresh carrier to a developing container, while discharging surplus developer.

SUMMARY OF THE INVENTION

According to one aspect of the present disclosure, a developing device is provided with a developing container, a first stirring conveyance member and a second stirring conveyance member, and a developer carrying member. The developing container stores therein a developer including a magnetic carrier and a toner. The first stirring conveyance member and the second stirring conveyance member stir and carry the developer within the developing container. The developer carrying member is disposed to face an image carrier on which an electrostatic latent image is formed, is rotatably supported by the developing container, and carries the developer supplied from the second stirring conveyance member. The developing container includes a first conveyance chamber, a second conveyance chamber, a partition portion, communication portions, and a discharge passage. In the first conveyance chamber, the developer is conveyed by the first stirring conveyance member. In the second conveyance chamber, the developer is conveyed by the second stirring conveyance member in a direction opposite to a direction in which the first stirring conveyance member conveys the developer. The partition portion separates the first conveyance chamber and the second conveyance chamber from each other. The communication portions are provided at both end portions of the partition portion in a longitudinal direction, and the first conveyance chamber and the second conveyance chamber communicate with each other through the communication portions. The discharge passage is formed to be continuous with a downstream side, in a developer conveyance direction, of one of the first conveyance chamber and the second conveyance chamber, and a developer discharge port for discharging surplus developer within the developing container is formed in the discharge passage. In the discharge passage, there is disposed a discharge screw that is formed to be continuous with an end portion of one of the first stirring conveyance member and the second stirring conveyance member, and that has a rotation shaft and a spiral blade provided on a peripheral surface of the rotation shaft. A discharge regulating member that regulates discharge of the developer is provided at a portion within the discharge passage on an upstream side of the developer discharge port in a developer discharge direction.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
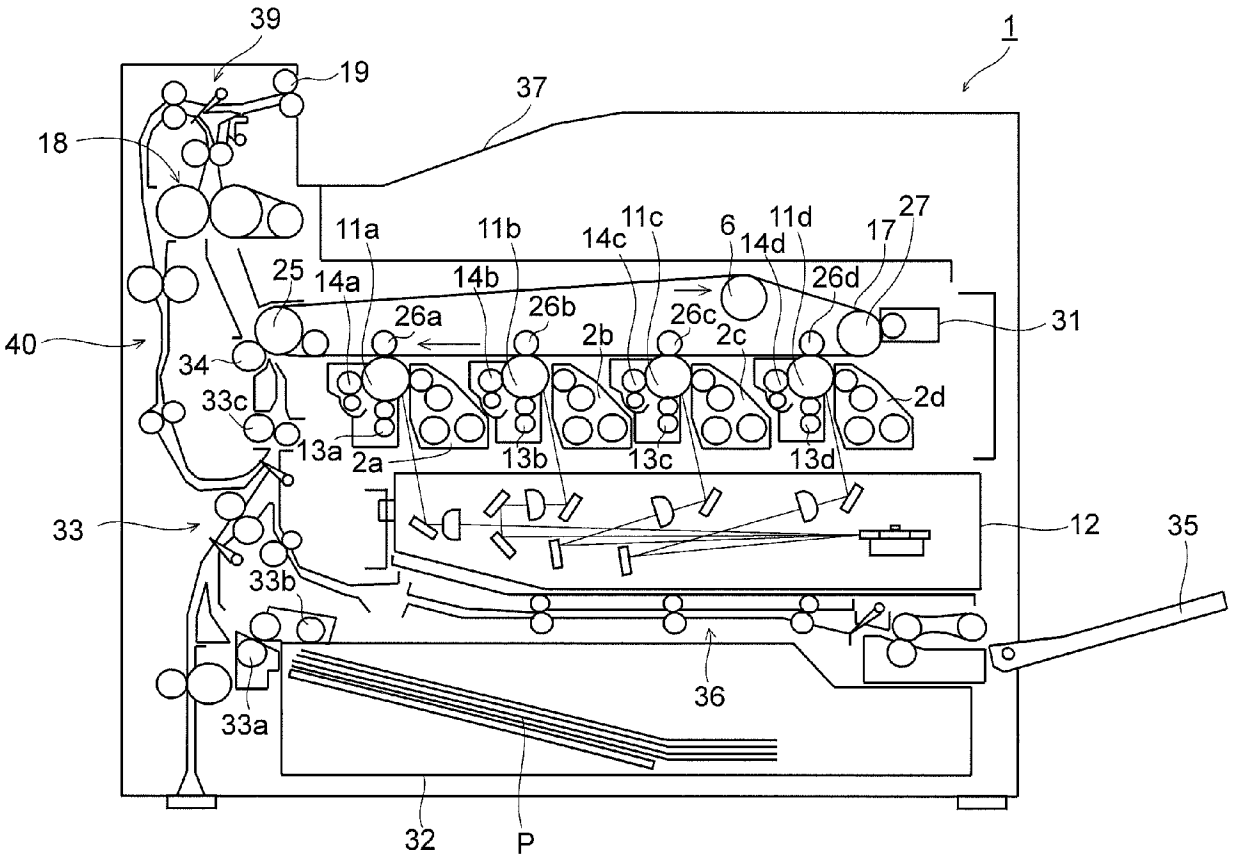
FIG. 1 is a sectional view schematically showing an overall configuration of an image forming apparatus provided with a developing device according to a first embodiment of the present disclosure.

Hereinafter, embodiments of the present disclosure will be described with reference to the accompanying drawings.

(First Embodiment)

With reference to FIG. 1 to FIG. 5, descriptions will be given of a structure of an image forming apparatus 1 provided with developing devices 2*a* to 2*d* according to a first embodiment of the present disclosure. The image forming apparatus 1 is a tandem type color printer in which rotatable photosensitive drums (image carriers) 11*a* to 11*d* are arranged corresponding to colors of magenta, cyan, yellow, and black. The photosensitive drums 11*a* to 11*d* are, for example, organic photosensitive members (OPC photosensitive members) or amorphous silicon photosensitive members each having an amorphous silicon photosensitive layer. Around the photosensitive drums 11*a* to 11*d*, there are arranged developing devices 2*a* to 2*d*, an exposure unit 12, chargers 13*a* to 13*d*, and cleaning devices 14*a* to 14*d*.

The developing devices 2*a* to 2*d* are disposed to the right of, and facing, the photosensitive drums 11*a* to 11*d*, respectively, and supply toner to the photosensitive drums 11*a* to 11*d*, respectively. The chargers 13*a* to 13*d* are disposed upstream of the developing devices 2*a* to 2*d*, respectively, with respect to a direction in which the photosensitive drums rotate, the chargers 13 *a* to 13*d* facing surfaces of the photosensitive drums 11*a* to 11*d*, respectively, so as to uniformly charge the surfaces of the photosensitive drums 11 *a* to 11*d*, respectively.

The exposure unit 12 is provided for scanningly exposing the photosensitive drums 11*a* to 11*d* based on image data representing letters, patterns, etc. inputted to an image input portion (unillustrated) from a personal computer or the like. The exposure unit 12 is provided below the developing devices 2*a* to 2*d*. The exposure unit 12 is provided with a laser light source and polygon mirrors, and is also provided with reflection mirrors and lenses corresponding to the photosensitive drums 11*a* to 11*d*. Laser light emitted from the laser light source is applied to the surfaces of the photosensitive drums 11*a* to 11*d* from downstream sides of the chargers 13*a* to 13*d*, respectively, with respect to the direction in which the photosensitive drums rotate, via the polygon mirrors, the reflection mirrors, and the lenses. The laser light applied to the photosensitive drums 11*a* to 11*d* forms electrostatic latent images on the surfaces of the photosensitive drums 11*a* to 11*d*, and these electrostatic latent images are developed into toner images by the developing devices 2*a* to 2*d*.

An intermediate transfer belt 17, which is an endless belt, is wound around a tension roller 6, a drive roller 25, and a driven roller 27. The drive roller 25 is driven to rotate by an unillustrated motor, and the intermediate transfer belt 17 is driven to circulate by the rotation of the drive roller 25.

The photosensitive drums 11*a* to 11*d* are arrayed under, and in contact with, the intermediate transfer belt 17, side by side along a conveyance direction (a direction indicated by an arrow in FIG. 1). Primary transfer rollers 26*a* to 26*d* face the photosensitive drums 11*a* to 11*d*, respectively, with the intermediate transfer belt 17 in between, and the primary transfer rollers 26*a* to 26*d* are in press-contact with the intermediate transfer belt 17 to form a primary transfer portion. At the primary transfer portion, along with the rotation of the intermediate transfer belt 17, with predetermined timing, the toner images on the photosensitive drums 11*a* to 11*d* are transferred onto the intermediate transfer belt 17 one after another. Thereby, on a surface of the intermediate transfer belt 17, a full-color toner image is formed where the toner images of magenta, cyan, yellow, and black colors are superimposed one on another.

A secondary transfer roller 34 faces the drive roller 25 with the intermediate transfer belt 17 in between, and is in press-contact with the intermediate transfer belt 17 to form a secondary transfer portion. At this secondary transfer portion, the toner image formed on the surface of the intermediate transfer belt 17 is transferred onto a sheet P. After the transfer, a belt cleaning device 31 cleans the intermediate transfer belt 17 to remove residual toner therefrom.

At a lower portion within the image forming apparatus 1, there is disposed a sheet cassette 32 where sheets P are stored, and to the right of the sheet cassette 32, there is disposed a stack tray 35 for manual sheet feeding. To the left of the sheet cassette 32, there is disposed a first sheet conveyance passage 33 along which a sheet P fed out from the sheet cassette 32 is conveyed to the secondary transfer portion of the intermediate transfer belt 17. To the left of the stack tray 35, there is disposed a second sheet conveyance passage 36 along which a sheet fed out from the stack tray 35 is conveyed to the secondary transfer portion. Furthermore, in an upper left portion within the image forming apparatus 1, there are disposed a fixing portion 18 that performs a fixing process on a sheet P on which an image has been formed, and a third sheet conveyance passage 39 along which a sheet having undergone the fixing process is conveyed to a sheet delivery portion 37.

The sheet cassette 32 is withdrawable to outside a body of the image forming apparatus 1 (front side of FIG. 1) for replenishment with sheets. Sheets P stored in the sheet cassette 32 are fed out one by one toward the first sheet conveyance passage 33 by a pickup roller 33*b* and a separation roller 33*a*.

The first sheet conveyance passage 33 and the second sheet conveyance passage 36 join together at a position before a registration roller pair 33*c*, which sends the sheet P forward toward the second transfer portion with timing coordinated with the image forming operation at the secondary transfer belt 17 and the sheet feeding operation. Onto the sheet P conveyed to the secondary transfer portion, the secondary transfer roller 34 to which a bias potential is applied secondarily transfers the full-color toner image formed on the intermediate transfer belt 17, and thereafter, the sheet P is conveyed to the fixing portion 18.

The fixing portion 18 is provided with a fixing belt to which heat is applied by a heater, a fixing roller that is in contact with an inner surface of the fixing belt, a pressure roller that is disposed to be in press-contact with the fixing roller with the fixing belt in between, etc., and the fixing portion 18 performs the fixing process by applying heat and pressure to the sheet P onto which the toner image has been transferred. After the toner image is fixed on the sheet P at the fixing portion 18, the sheet P is turned upside down through a fourth sheet conveyance passage 40, as necessary, and a toner image is secondarily transferred onto a back side of the sheet P as well, to be fixed at the fixing portion 18. The sheet P on which the toner image has been fixed passes through the third sheet conveyance passage 39, and is then discharged by a delivery roller pair 19 to the sheet delivery portion 37.

Next, with reference to FIG. 2, a description will be given of a detailed structure of the developing device 2*a*. The following description will describe the structure and operations of the developing device 2*a* which corresponds to the photosensitive drum 11*a* shown in FIG. 1, and the following description will not describe structures or operations of the developing devices 2*b* to 2*d*, each of which has the same structure and operates in the same manner as the developing device 2*a*. Also, the developing devices and the photosensitive drums will be denoted without reference signs "a" to "d" to indicate difference in color.

Figure 2:
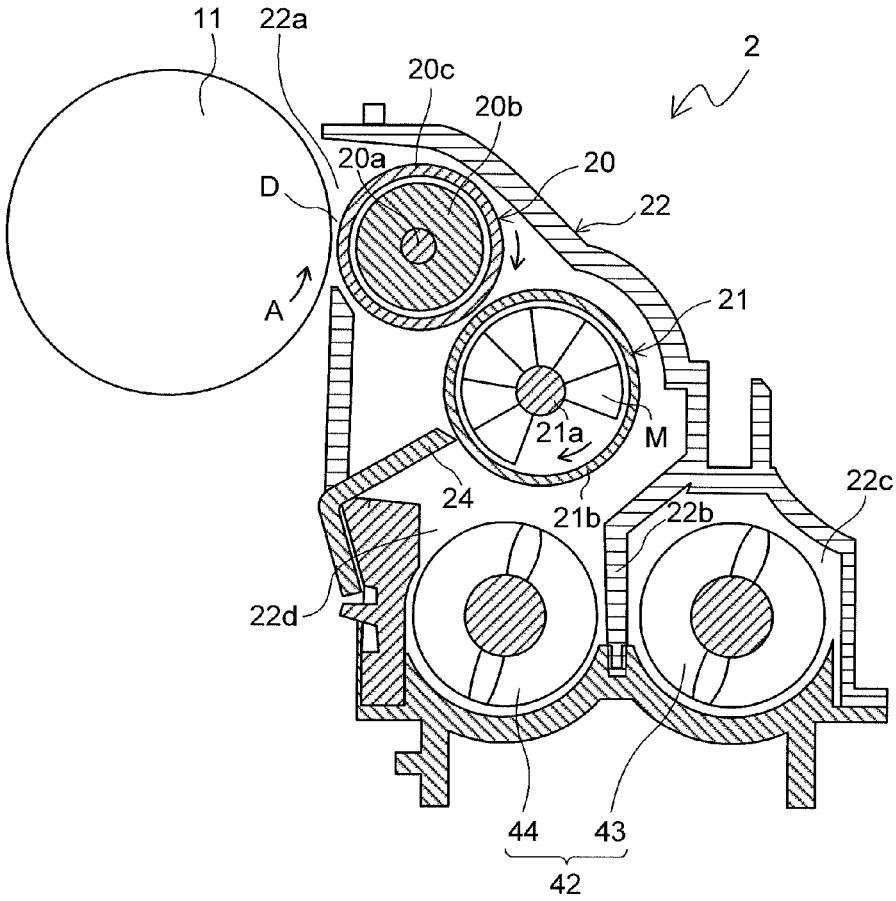
FIG. 2 is a side sectional view showing a structure of the developing device according to the first embodiment of the present disclosure.

As shown in FIG. 2, the developing device 2 is constituted by a developing roller (developer carrying member) 20, a magnetic roller 21, a regulating blade 24, a stirring conveyance member 42, a developing container 22, etc.

The developing container 22 constitutes an outer frame of the developing device 2, and a lower portion of the developing container 22 is partitioned by a partition portion 22*b* into a first conveyance chamber 22*c* and a second conveyance chamber 22*d*. A developer including a toner and a carrier is stored in the first conveyance chamber 22*c* and the second conveyance chamber 22*d*. The developing container 22 rotatably holds the stirring conveyance member 42, the magnetic roller 21, and the developing roller 20. Furthermore, in the developing container 22, there is formed an opening 22*a* through which the developing roller 20 is exposed toward the photosensitive drum 11.

The developing roller 20 is disposed facing, and to the right of, the photosensitive drum 11 with a certain distance in between. The developing roller 20, at an opposing position close to the photosensitive drum 11, forms a developing region D where the toner is supplied to the photosensitive drum 11. The magnetic roller 21 faces the developing roller 20 with a certain distance in between, and is disposed to a lower right of the developing roller 20. The magnetic roller 21, at an opposing position close to the developing roller 20, supplies the toner to the developing roller 20. The stirring conveyance member 42 is disposed substantially under the magnetic roller 21. The regulating blade 24 is disposed to a lower left of the magnetic roller 21 and is fixedly held by the developing container 22.

The stirring conveyance member 42 is constituted by two spirals, namely, a first spiral (first stirring conveyance member) 43 and a second spiral (second stirring conveyance member) 44. The second spiral 44 is disposed in the second conveyance chamber 22*d*, under the magnetic roller 21, and the first spiral 43 is disposed in the first conveyance chamber 22*c*, to be next to, and to the right of, the second spiral 44.

The first and second spirals 43 and 44 stir the developer to charge the toner in the developer to a predetermined level. Thereby, the toner is held by the carrier. Communication portions (an upstream-side communication portion 22*e* and a downstream-side communication portion 22*f*, which will be described later) are formed at two end portions of the partition portion 22*b* that separates the first conveyance chamber 22*c* from the second conveyance chamber 22*d* in a longitudinal direction (a direction perpendicular to the front-back direction of the sheet on which FIG. 2 is drawn), such that when the first spiral 43 rotates, the electrically-charged developer is conveyed through one of the communication portions formed in the partition portion 22*b* to the second spiral 44, and the developer circulates in the first conveyance chamber 22*c* and the second conveyance chamber 22*d*. And then, the developer is supplied from the second spiral 44 to the magnetic roller 21.

The magnetic roller 21 is provided with a roller shaft 21*a*, a magnetic-pole member M, and a nonmagnetic sleeve 21*b* formed of a nonmagnetic material. The magnetic roller 21 carries the developer supplied from the stirring conveyance member 42, and supplies to the developing roller 20 only the toner included in the developer that it carries. The magnetic-pole member M is configured such that a plurality of magnets that have a sector-shaped cross section and different polarities at outer peripheral portions thereof are alternately arranged, and the magnetic-pole member M is fixed to the roller shaft 21*a* by adhesion or the like. The roller shaft 21*a* is, at an inner side of the nonmagnetic sleeve 21*b*, unrotatably supported by the developing container 22 with a predetermined space provided between the magnetic-pole member M and the nonmagnetic sleeve 21*b*. The nonmagnetic sleeve 21*b* is driven by an unillustrated drive mechanism constituted by a motor and a gear to rotate in the same direction as the developing roller 20 (clockwise direction in FIG. 2). Also, a bias obtained by superposing an AC voltage on a DC voltage is applied to the nonmagnetic sleeve 21*b*. The electrically-charged developer is carried in a form of a magnetic brush formed on a surface of the nonmagnetic sleeve 21*b* by the magnetic force of the magnetic-pole member M, and a height of the magnetic brush is adjusted to a predetermined height by the regulating blade 24.

When the nonmagnetic sleeve 21*b* rotates, the magnetic brush, which is caused by the magnetic-pole member M to be carried on the surface of the nonmagnetic sleeve 21*b*, is conveyed, and when the magnetic brush comes into contact with the developing roller 20, only the toner in the magnetic brush is supplied to the developing roller 20 according to the bias applied to the nonmagnetic sleeve 21*b*.

The developing roller 20 is constituted by being provided with a stationary shaft 20*a*, a magnetic-pole member 20*b*, a developing sleeve 20*c* formed of a nonmagnetic metal material in a cylindrical shape, etc.

The stationary shaft 20*a* is unrotatably supported by the developing container 22. The developing sleeve 20*c* is rotatably held around the stationary shaft 20*a*, and further, the magnetic-pole member 20*b* formed of a magnet is fixed to the stationary shaft 20*a* by adhesion or the like at a position facing the magnetic roller 21, with a predetermined distance between the developing sleeve 20*c* and the magnetic-pole member 20*b*. The developing sleeve 20*c* is driven by an unillustrated drive mechanism provided with a motor and a gear, to rotate in a direction (clockwise direction) indicated by an arrow in FIG. 2. Also, to the developing sleeve 20*c*, a developing bias obtained by superposing an AC voltage on a DC voltage is applied.

When the developing sleeve 20*c* to which the developing bias has been applied rotates in the clockwise direction in FIG. 2, then in the developing region D, a difference between a potential of the developing bias and potentials of exposed portions of the photosensitive drum 11 causes the toner carried on the surface of the developing sleeve 20*c* to fly to the photosensitive drum 11. The flying toner reaches and adheres to the exposed portions on the photosensitive drum 11 sequentially, while the photosensitive drum 11 rotating in the direction indicated by arrow A (counterclockwise direction), and thereby, the electrostatic latent image on the photosensitive drum 11 is developed.

Next, with reference to FIG. 3, a detailed description will be given of a stirring portion of the developing device.

In the developing container 22, in which the first conveyance chamber 22*c*, the second conveyance chamber 22*d*, the partition portion 22*b*, the upstream-side communication portion 22*e*, and the downstream-side communication portion 22*f* are formed as already described above, there are further formed a developer replenishing port 22*g*, a developer discharge portion (discharge passage) 22*h*, an upstream-side wall portion 22*i*, and a downstream-side wall portion 22*j*. In the first conveyance chamber 22*c*, the left side in FIG. 3 is assumed to be the upstream side and the right side in FIG. 3 is assumed to be the downstream side, while in the second conveyance chamber 22*d*, the right side in FIG. 3 is assumed to be the upstream side and the left side in FIG. 3 is assumed to be the downstream side. Thus, "upstream-side" and "downstream-side" with which the communication portions and the wall portions are denoted is based on the second conveyance chamber 22*d*.

The partition portion 22*b* extends in a longitudinal direction of the developing container 22 to separate the first conveyance chamber 22*c* and the second conveyance chamber 22*d* from each other to be parallel to each other. A right-side end portion of the partition portion 22*b* in the longitudinal direction and an inner wall portion of the upstream-side wall portion 22*i* together form the upstream-side communication portion 22*e*, while a left-side end portion of the partition portion 22*b* in the longitudinal direction and an inner wall portion of the downstream-side wall portion 22*j* together form the downstream-side communication portion 22*f*. This allows the developer to circulate in the first conveyance chamber 22*c*, the upstream-side communication portion 22*e*, the second conveyance chamber 22*d*, and the downstream-side communication portion 22*f*.

Figure 3:
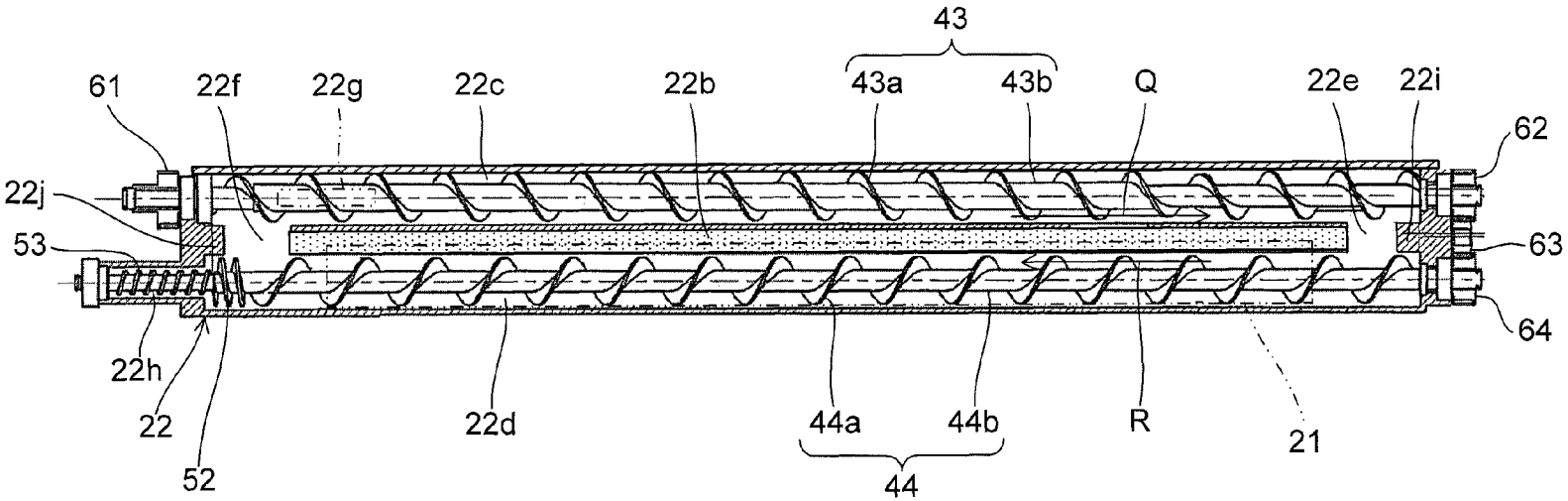
FIG. 3 is a plan sectional view showing a structure of a lower portion of the developing device according to the first embodiment of the present disclosure.

The developer replenishing port 22*g* is an opening through which fresh toner and carrier are added to the developing container 22 from a developer replenishing container (not shown) formed at an upper portion of the developing container 22, and the developer replenishing port 22*g* is formed in an upper portion of the first conveyance chamber 22*c* on the upstream side (left side in FIG. 3).

The developer discharge portion (discharge passage) 22*h* is a portion for discharging therethrough surplus developer in the first and second conveyance chambers 22*c* and 22*d* after replenishment with developer, and the developer discharge portion 22*h* is provided in a cylindrical shape located on the downstream side (downstream side in a developer conveyance direction) of the second conveyance chamber 22*d* to be continuous with the second conveyance chamber 22*d* in the longitudinal direction.

In the first conveyance chamber 22*c*, the first spiral 43 is disposed, and in the second conveyance chamber 22*d*, the second spiral 44 is disposed.

The first spiral 43 has a rotation shaft 43*b* and a first spiral blade 43*a* that is integrally formed with the rotation shaft 43*b*, in a spiral form winding around the rotation shaft 43*b* at a uniform pitch along the axial direction of the rotation shaft 43*b*. The first spiral blade 43*a* extends to both end portions of the first conveyance chamber 22*c* in the longitudinal direction, so that it also faces the upstream-side and downstream-side communication portions 22*e* and 22*f*. The rotation shaft 43*b* is rotatably supported by the upstream-side wall portion 22*i* and the downstream-side wall portion 22*j* of the developing container 22.

The second spiral 44 has a rotation shaft 44*b* and a spiral blade 44*a* that is integrally formed with the rotation shaft 44*b* as a blade in a spiral form winding at the same pitch as the first spiral blade 43*a* along the axial direction of the rotation shaft 44*b* but in a direction (opposite phase) that is opposite to the winding direction of the first spiral blade 43*a*. The second spiral blade 44*a* has a length equal to or longer than that of the magnetic roller 21 in the axial direction, and it also provided to face the upstream-side communication portion 22*e* and the downstream-side communication portion 22*f*. The rotation shaft 44*b* is disposed parallel to the rotation shaft 43*b*, and is rotatably supported by the upstream-side wall portion 22*i* and the downstream-side wall portion 22*j* of the developing container 22.

Furthermore, in addition to the second spiral blade 44*a*, a regulation portion 52 and a discharge blade (spiral blade) 53 are integrally disposed with the rotation shaft 44*b*.

The regulation portion 52 is provided to block the developer conveyed to the downstream side within the second conveyance chamber 22*d*, and also to convey surplus developer to the developer discharge portion 22*h* when the amount of developer exceeds a predetermined amount. The regulation portion 52 is a spiral blade provided on the rotation shaft 44*b*; it is formed in a spiral form with a blade wound in a direction (opposite phase) opposite to the winding direction of the second spiral blade 44*a*, and is also formed with substantially the same external diameter as the second spiral blade 44*a*, and at the pitch smaller than the pitch of the second spiral blade 44*a*. Furthermore, the regulation portion 52 is disposed such that a gap of a predetermined amount is formed between an inner wall portion (inner peripheral surface) of the developing container 22 including the downstream-side wall portion 22*j*, and an outer peripheral portion of the regulation portion 52. Through this gap, surplus developer moves to the developer discharge portion 22*h*.

The rotation shaft 44*b* extends as far as into the developer discharge portion 22*h*. On a peripheral surface of a portion of the rotation shaft 44*b* located within the developer discharge portion 22*h*, there is provided a discharge blade 53. Here, the portion of the rotation shaft 44*b* located within the developer discharge portion 22*h* and the discharge blade 53 together constitute a discharge screw for discharging surplus developer. The discharge blade 53 is formed as a spiral blade winding in the same direction as the winding direction of the second spiral blade 44*a*, but at a pitch smaller than the second spiral blade 44*a*, and the discharge blade 53 has a smaller outer periphery (external diameter) than the second spiral blade 44*a*. When the rotation shaft 44*b* rotates, the discharge blade 53 also rotates with it, and the surplus developer conveyed over the regulation portion 52 into the developer discharge portion 22*h* is sent to the left side in FIG. 3 by the discharge screw (the rotation shaft 44*b*, the discharge blade 53), and is then discharged to outside the developing container 22. The discharge blade 53, the regulation portion 52, and the second spiral blade 44*a* are formed of a synthetic resin to be integral with the rotation shaft 44*b*. The rotation shaft 44*b* may be formed of resin, or may be formed of metal.

Moreover, in a lower portion of the outer peripheral surface of the developer discharge portion 22*h*, there is formed a discharge port (developer discharge port) 65 (see FIG. 4) that communicates with a conveyance pipe (not shown) through which the developer is conveyed to a collection container (not shown). In the present embodiment, no shutter for opening/closing the discharge port 65 is attached to the outer peripheral surface of the developer discharge portion 22*h*.

Figure 4:
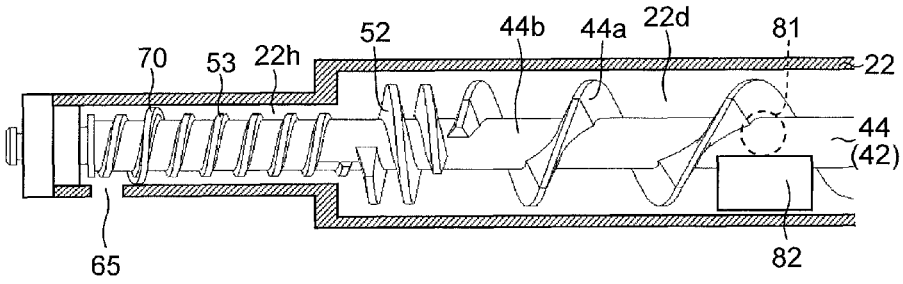
FIG. 4 is a side sectional view showing a structure around a developer discharge portion of the developing device according to the first embodiment of the present disclosure.

In the developing device 2 according to the present disclosure, as shown in FIG. 4, at a position to the right (on the upstream side in the developer discharge direction) of the discharge port 65 within the developer discharge portion 22*h*, there is provided a discharge regulating member (a blade diameter enlarging portion 70 in the present embodiment) that regulates discharge of the developer. This discharge regulating member is provided in the vicinity of the discharge port 65 of the developer discharge portion 22*h*.

Figure 5:
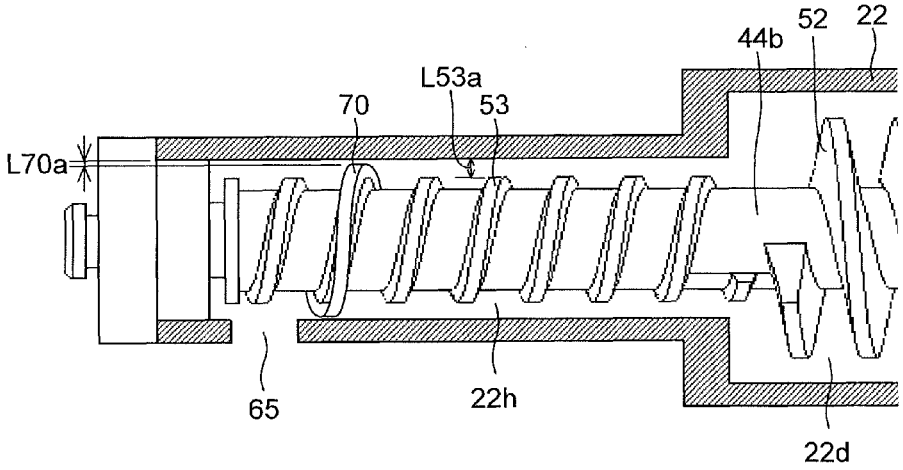
FIG. 5 is an enlarged side sectional view showing the structure of the developer discharge portion of the developing device according to the first embodiment of the present disclosure.

In the present embodiment, the discharge regulating member is the blade diameter enlarging portion 70 wound at least once around an outer peripheral surface of the discharge blade 53. As shown in FIG. 5, between an outer peripheral surface of the blade diameter enlarging portion 70 and the inner peripheral surface of the developer discharge portion 22*h*, there is provided a gap L70*a* (for example, 0.1 mm to 0.3 mm), which is narrower than a gap L53*a* (for example, 1 mm) between the outer peripheral surface of a portion of the discharge blade 53 that is not provided with the blade diameter enlarging portion 70 and the inner peripheral surface of the developer discharge portion 22*h*. Here, the gap L70*a* between the outer peripheral surface of the blade diameter enlarging portion 70 and the inner peripheral surface of the developer discharge portion 22*h* is not indispensable. That is, the blade diameter enlarging portion 70 may be in contact with the inner peripheral surface of the developer discharge portion 22*h*.

The blade diameter enlarging portion 70 may be integrally formed with the discharge blade 53, or may be formed as a member separate from the discharge blade 53 and fixed to the outer peripheral surface (outer peripheral portion) of the discharge blade 53. The blade diameter enlarging portion 70 may be formed of the same material as the discharge blade 53, or may be formed of a different material from the discharge blade 53. Note that, in a case where the blade diameter enlarging portion 70 is set such that the outer peripheral surface thereof is in contact with the inner peripheral surface of the developer discharge portion 22*h*, the blade diameter enlarging portion 70 is preferably formed of a material (such as an elastomer) that is softer than the materials of the discharge blade 53 and the developing container 22.

As shown in FIG. 3, gears 61 to 64 are disposed at an outer wall of the developing container 22. The gears 61 and 62 are fixed to the rotation shaft 43*b*, the gear 64 is fixed to the rotation shaft 44*b*, and the gear 63 is rotatably held by the developing container 22 and meshes with the gears 62 and 64.

Next, a description will be given of a case where the developer is added through the developer replenishing port 22*g*. When the toner is consumed through development, the developer including the toner and the carrier is added through the developer replenishing port 22*g* into the first conveyance chamber 22*c*.

The added developer is stirred while being conveyed to circulate from the first conveyance chamber 22*c* through the upstream-side communication portion 22*e*, the second conveyance chamber 22*d*, and the downstream-side communication portion 22*f*, and surplus developer within the developing container 22 flows over a reverse spiral blade 52 to be conveyed to the developer discharge portion 22*h*. This allows the developing container 22 to constantly hold an appropriate amount of developer, and this helps prevent uneven supply of the developer to the magnetic roller 21 caused by the second spiral 44, and thus, it is possible to achieve a stable and uniform supply of the developer to the magnetic roller 21.

As shown in FIG. 4, within the second conveyance chamber 22*d*, at a position adjacent to the downstream-side communication portion 22*f* on an upstream side thereof in the developer conveyance direction, a toner concentration detecting sensor 81 is disposed. In FIG. 4, the second spiral 44 is located in front of the toner concentration detecting sensor 81, and thus the toner concentration detecting sensor 81 is indicated by a broken line.

Used as the toner concentration detecting sensor 81 is a magnetic permeability sensor that detects magnetic permeability of the developer within the developing container 22. When the magnetic permeability of the developer is detected by the toner concentration detecting sensor 81, a voltage value corresponding to the detection result is outputted to a control portion (not shown), and then, the control portion determines the toner concentration based on the output value of the toner concentration detecting sensor 81.

Furthermore, the second spiral 44 is provided with a scraper 82 disposed at a portion of the second spiral 44 that faces the toner concentration detecting sensor 81. As the scraper 82, for example, a laminated member obtained by laminating a nonwoven fabric on a flexible film serving as a base material is used. The scraper 82 is attached to a scraper support portion (not shown) that is formed on the rotation shaft 44*b* of the second spiral 44 such that the scraper 82 is parallel with respect to the rotation shaft 44*b*. By the scraper 82 rotating along with the rotation shaft 44*b*, a detection surface of the toner concentration detecting sensor 81 is scraped and cleaned by the scraper 82, and the developer is promoted to stay to the portion where the sensor is disposed.

In the present embodiment, as described above, within the developer discharge portion 22*h*, at a portion on the upstream side of the discharge port 65 in the developer discharge direction, the discharge regulating member (blade diameter enlarging portion 70) is provided to regulate discharge of the developer. Thus, it is possible to regulate, by means of the discharge regulating member, movement of the developer within the developer discharge portion 22*h* from the second conveyance chamber 22*d* to the discharge port 65. As a result, whether the developing device 2 is transported in a state of being attached to the body of the image forming apparatus 1 or in a state of being packed separate from the body of the image forming apparatus 1, it is possible to regulate leakage of the developer through the discharge port 65 caused by vibration, shock, or the like during transport.

Furthermore, since no shutter is provided to shut the discharge port 65 of the developing device 2, a serviceperson does not have to open up a shutter at the time of setting up the image forming apparatus 1. This makes it possible to improve the setting-up workability compared with a case where a shutter is provided for the discharge port 65. In addition, this helps prevent the serviceperson from inadvertently forgetting to open up the discharge port 65, so that there is no risk of the developer getting trapped in the vicinity of the discharge port 65 to disadvantageously increase the developer pressure.

Moreover, as described above, the discharge regulating member is provided in the vicinity of the discharge port 65 within the developer discharge portion 22*h*. This makes it possible to shorten the distance between the discharge regulating member and the discharge port 65, and thus to reduce the amount of developer accumulating on the discharge port 65 side of the discharge regulating member. As a result, when the developing device 2 is transported in the state of being attached to the body of the image forming apparatus 1, it is possible to further regulate the leakage of the developer accumulated between the discharge port 65 and the discharge regulating member caused by vibration, shock, or the like during transport.

Furthermore, as described above, as the discharge regulating member, the blade diameter enlarging portion 70 is provided to be wound at least once around the outer peripheral surface of the discharge blade 53 such that the gap L70*a* between the outer peripheral surface of the blade diameter enlarging portion 70 and the inner peripheral surface of the developer discharge portion 22*h* is narrower than the gap L53*a* between the outer peripheral surface of the portion of the discharge blade 53 that is not provided with the blade diameter enlarging portion 70 and the inner peripheral surface of the developer discharge portion 22*h*. This makes it possible to easily regulate passage of the developer past the discharge regulating member (the blade diameter enlarging portion 70), and thus to easily regulate leakage of the developer through the discharge port 65.

(Second Embodiment)

Next, with reference to FIG. 6 to FIG. 8, a description will be given of a discharge regulating member according to the second embodiment of the present disclosure.

Figure 6:
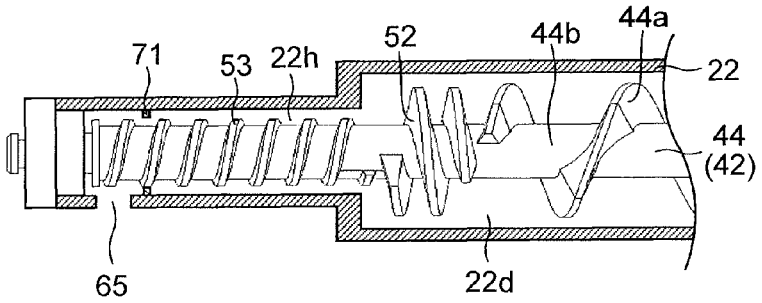
FIG. 6 is a side sectional view showing a structure around a developer discharge portion of a developing device according to a second embodiment of the present disclosure.
Figure 7:
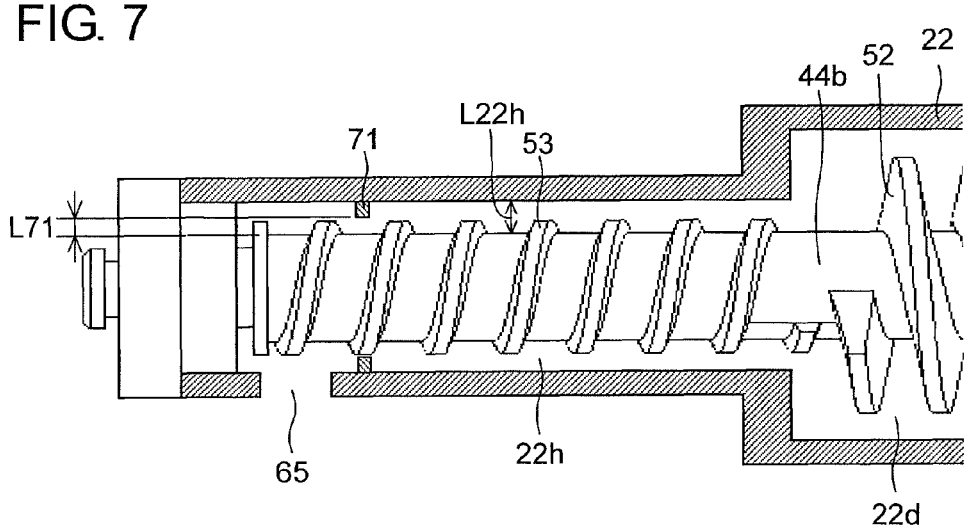
FIG. 7 is an enlarged side sectional view showing the structure of the developer discharge portion of the developing device according to the second embodiment of the present disclosure.

The discharge regulating member according to the second embodiment of the present disclosure is different from its counterpart in the above-described first embodiment in that it is fixed to a developing container 22 as shown in FIG. 6. The discharge regulating member according to the present embodiment is a ring member 71 provided on the inner peripheral surface of the developer discharge portion 22*h* along a circumferential direction of the developer discharge portion 22*h*. As shown in FIG. 7, the ring member 71 is formed to protrude from the inner peripheral surface of the developer discharge portion 22*h* toward the discharge screw (the rotation shaft 44*b*, the discharge blade 53). A groove may be formed in the inner peripheral surface of the developer discharge portion 22*h* along the circumferential direction of the developer discharge portion 22*h*, such that the ring member 71 is attached to the developer discharge portion 22*h* by fitting an outer edge portion of the ring member 71 into the groove. Alternatively, the ring member 71 may be integrally formed with the developing container 22.

A gap L71 between an inner peripheral surface of the ring member 71 and the peripheral surface of the rotation shaft 44*b* is narrower than a gap L22*h* between the inner peripheral surface of a portion of the developer discharge portion 22*h* that is not provided with the ring member 71 and the peripheral surface of the rotation shaft 44*b*.

Figure 8:
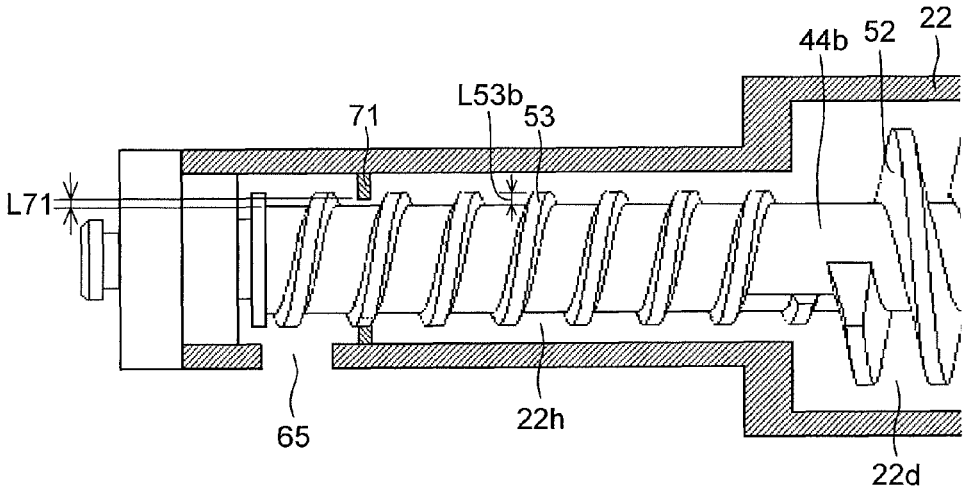
FIG. 8 is an enlarged side sectional view showing the structure of the developer discharge portion of the developing device according to the second embodiment of the present disclosure.

Furthermore, as shown in FIG. 8, the gap L71 between the inner peripheral surface of the ring member 71 and the peripheral surface of the rotation shaft 44*b* may be narrower than a distance (height by which the discharge blade 53 protrudes with respect to the peripheral surface of the rotation shaft 44*b*) L53*b* between the outer peripheral surface of the discharge blade 53 and the peripheral surface of the rotation shaft 44*b*. That is, the ring member 71 and the discharge blade 53 may be in contact with each other. It is preferable, however, that the inner peripheral surface of the ring member 71 be located a predetermined distance away from the peripheral surface of the rotation shaft 44*b* (that is, out of contact with the rotation shaft 44*b*).

The ring member 71 may be formed of the same material as the developing container 22, or may be formed of a different material from the developing container 22. Here, in the case where the ring member 71 is set in contact with the discharge blade 53, it is preferable that the ring member 71 be formed of a material (such as an elastomer) that is softer than that of the discharge blade 53.

Other structures of the second embodiment are similar to those of the first embodiment described above.

According to the present embodiment, as described above, as the discharge regulating member, the ring member 71 is provided on the inner peripheral surface of the developer discharge portion 22*h* along the circumferential direction of the developer discharge portion 22*h*, and the gap L71 between the inner peripheral surface of the ring member 71 and the peripheral surface of the rotation shaft 44*b* is narrower than the gap L22*h* between the inner peripheral surface of the portion of the developer discharge portion 22*h* that is not provided with the ring member 71 and the peripheral surface of the rotation shaft 44*b*. This makes it possible to easily regulate passage of the developer through the discharge regulating member (ring member 71), and thus to easily regulate leakage of the developer through the discharge port 65.

Furthermore, as described above, the gap L71 between the inner peripheral surface of the ring member 71 and the peripheral surface of the rotation shaft 44*b* may be narrower than the distance L53*b* between the outer peripheral surface of the discharge blade 53 and the peripheral surface of the rotation shaft 44*b*. That is, as seen from the axial direction of the rotation shaft 44*b*, the discharge regulating member (ring member 71) and the discharge blade 53 may lap over each other (overlap each other) such that there is no gap in between. In this case, passage of the developer past the discharge regulating member (ring member 71) can be further regulated, and thus, leakage of the developer through the discharge port 65 can be further regulated.

Moreover, as described above, the inner peripheral surface of the ring member 71 is located a predetermined distance away from the peripheral surface of the rotation shaft 44*b*. This makes it possible, when surplus developer is discharged, to prevent the ring member 71 from blocking the discharging of the developer.

Other advantages of the second embodiment are similar to those of the first embodiment described above.

(Third Embodiment)

Next, with reference to FIG. 9 to FIG. 11, a description will be given of a discharge regulating member according to a third embodiment of the present disclosure.

Figure 9:
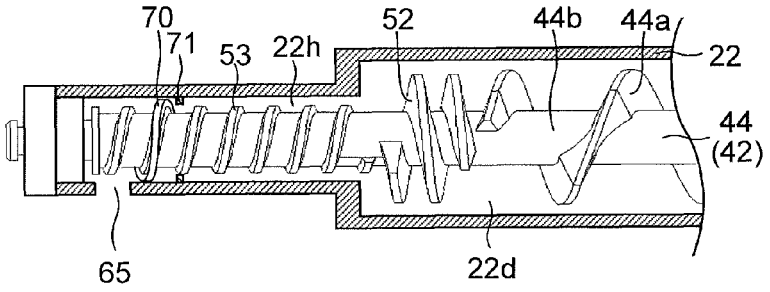
FIG. 9 is a side sectional view showing a structure around a developer discharge portion of a developing device according to a third embodiment of the present disclosure.
Figure 10:
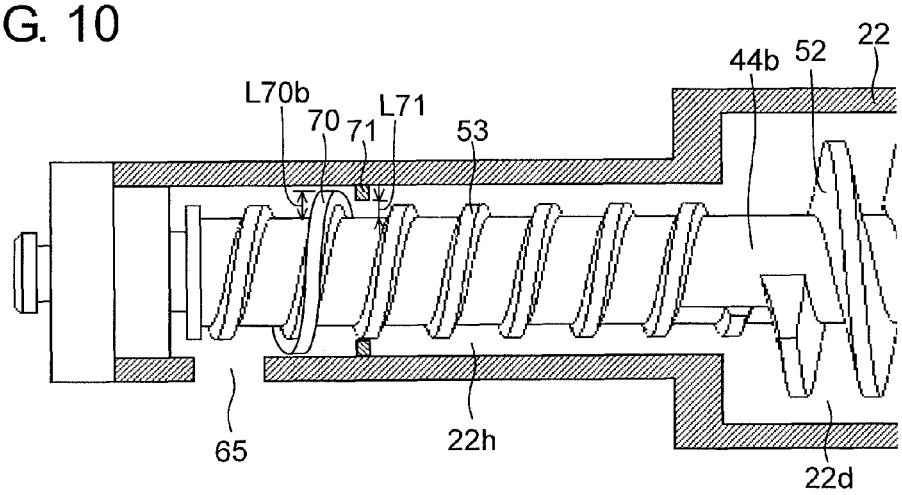
FIG. 10 is an enlarged side sectional view showing the structure of the developer discharge portion of the developing device according to the third embodiment of the present disclosure.

As shown in FIG. 9, the discharge regulating member according to the third embodiment of the present disclosure is constituted by the blade diameter enlarging portion 70 and the ring member 71. In the present embodiment, as shown in FIG. 10, the gap L71 between the inner peripheral surface of the ring member 71 and the peripheral surface of the rotation shaft 44*b* is narrower than a distance (height by which the blade diameter enlarging portion 70 protrudes with respect to the peripheral surface of the rotation shaft 44*b*) L70*b* between the outer peripheral surface of the blade diameter enlarging portion 70 and the peripheral surface of the rotation shaft 44*b*.

Figure 11:
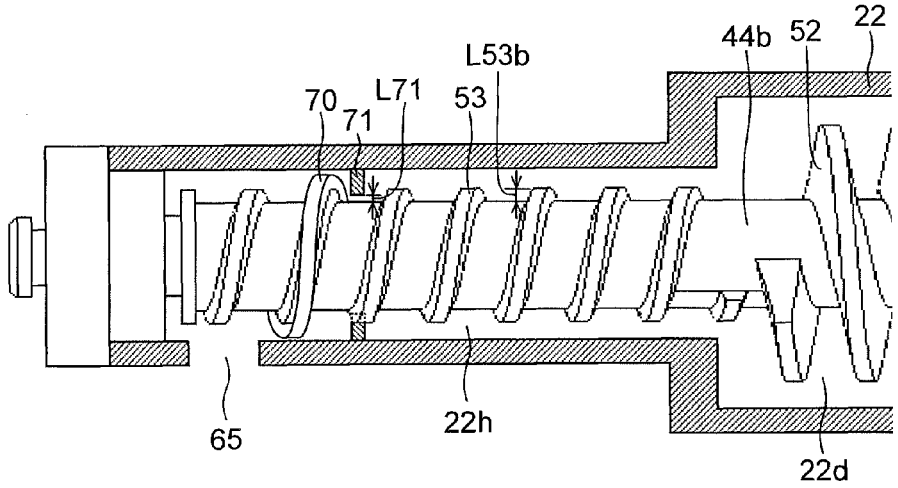
FIG. 11 is an enlarged side sectional view showing the structure of the developer discharge portion of the developing device according to the third embodiment of the present disclosure.

Furthermore, as shown in FIG. 11, the gap L71 between the inner peripheral surface of the ring member 71 and the peripheral surface of the rotation shaft 44*b* may be narrower than the distance L53*b* between the outer peripheral surface of the discharge blade 53 and the peripheral surface of the rotation shaft 44*b*.

Other structures of the third embodiment are similar to those of the first and second embodiments described above.

In the present embodiment, as described above, the blade diameter enlarging portion 70 and the ring member 71 are provided as two discharge regulating members. In this case as well, like in the first and second embodiments, it is possible to easily regulate leakage of the developer through the discharge port 65. Moreover, the gap L71 between the inner peripheral surface of the ring member 71 and the peripheral surface of the rotation shaft 44*b* is narrower than the distance L70*b* between the outer peripheral surface of the blade diameter enlarging portion 70 and the peripheral surface of the rotation shaft 44*b*. That is, as seen from the axial direction of the rotation shaft 44*b*, the two discharge regulating members (the ring member 71 and the blade diameter enlarging portion 70) may lap over each other (overlap each other) such that there is no gap in between. In this case, passage of the developer past the discharge regulating members (the ring member 71 and the blade diameter enlarging portion 70) can be further regulated, and thus, leakage of the developer through the discharge port 65 can be further regulated.

Other advantages of the third embodiment are similar to those of the first and second embodiments described above.

(Fourth Embodiment)

Next, with reference to FIG. 12 and FIG. 13, a description will be given of a discharge regulating member according to a fourth embodiment of the present disclosure.

Figure 12:
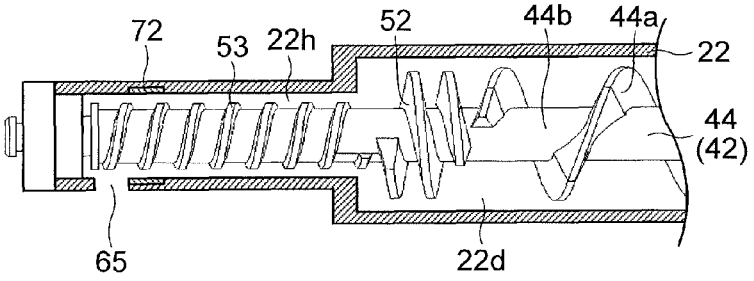
FIG. 12 is a side sectional view showing a structure around a developer discharge portion of a developing device according to a fourth embodiment of the present disclosure.

Unlike the discharge regulating members according to the above embodiments, the discharge regulating member according to the fourth embodiment of the present disclosure is a magnetic body 72 disposed on the inner peripheral surface of the developer discharge portion 22*h* along the circumferential direction of the developer discharge portion 22*h* as shown in FIG. 12. The magnetic body 72 is fitted in a groove formed in the inner peripheral surface of the developer discharge portion 22*h* along the circumferential direction of the developer discharge portion 22*h*. Here, the magnetic body 72 may protrude from the inner peripheral surface of the developer discharge portion 22*h* to such an extent that the magnetic body 72 does not contact the discharge screw (the rotation shaft 44*b*, the discharge blade 53).

Figure 13:
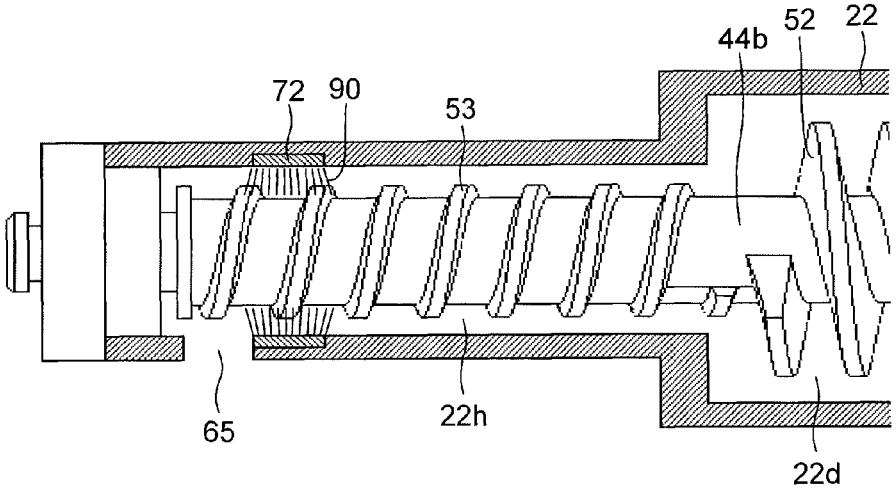
FIG. 13 is an enlarged side sectional view showing the structure of the developer discharge portion of the developing device according to the fourth embodiment of the present disclosure.

As shown in FIG. 13, the magnetic carrier within the developer discharge portion 22*h* is captured by the magnetic body 72 and formed into a brush-like shape (a magnetic brush 90). The magnetic brush (the magnetic carrier) 90 fills the gap (the gap is reduced) between the magnetic body 72 and the discharge screw (the rotation shaft 44*b*, the discharge blade 53).

Other structures of the fourth embodiment are similar to those of the first embodiment described above.

In the present embodiment, as described above, the magnetic body 72 is provided as the discharge regulating member on the inner peripheral surface of the developer discharge portion 22*h* along the circumferential direction of the developer discharge portion 22*h*. With this structure, the magnetic carrier is captured by the magnetic body 72, and with the captured magnetic carrier, the gap between the magnetic body 72 and the discharge screw is filled (the gap is reduced). Thus, passage of the developer past the magnetic body 72 can be easily regulated, and thus it is possible to easily regulate leakage of the developer through the discharge port 65.

Other advantages of the fourth embodiment are similar to those of the first embodiment described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the present disclosure is applicable not only to the tandem type color printer as shown in FIG. 1, but also to various image forming apparatuses provided with a developing device including a discharge passage in which a developer discharge port is formed, such as digital or analogue monochrome copiers, color copiers, and facsimile machines.

The above-described embodiments have dealt with examples where the developing device 2 is not provided with a shutter, but this is not meant to limit the present disclosure, and a shutter for opening/closing the discharge port 65 may be attached to the outer peripheral surface of the developer discharge portion 22*h* in the developing device 2.

The above described first, second, and fourth embodiments have dealt with examples where one blade diameter enlarging portion 70, one ring member 71, or one magnetic body 72 is provided, but this is not meant to limit the present disclosure, and a plurality of blade diameter enlarging portions 70, ring members 71 or magnetic bodies 72 may be provided.

It should be understood that configurations obtained by appropriately combining the configurations of the foregoing embodiments and modified examples are also included in the scope of the present disclosure.

What is claimed is:

1. A developing device, comprising:

a developing container that stores therein a developer including a magnetic carrier and a toner, a first stirring conveyance member and a second stirring conveyance member that stir and convey the developer within the developing container; and a developer carrying member that is disposed to face an image carrier on which an electrostatic latent image is formed, that is rotatably supported by the developing container, and that carries the developer supplied from the second stirring conveyance member, wherein the developing container includes a first conveyance chamber where the developer is conveyed by the first stirring conveyance member, a second conveyance chamber where the developer is conveyed by the second stirring conveyance member in a direction opposite to a direction in which the first stirring conveyance member conveys the developer, a partition portion that separates the first conveyance chamber and the second conveyance chamber from each other, communication portions that are provided at both end portions of the partition portion in a longitudinal direction, and through which the first conveyance chamber and the second conveyance chamber communicate with each other, and a discharge passage that is provided to be continuous with a downstream side, in a developer conveyance direction, of one of the first conveyance chamber and the second conveyance chamber, and in which a developer discharge port for discharging surplus developer within the developing container is formed;

wherein, in the discharge passage, there is disposed a discharge screw that is provided to be continuous with an end portion of one of the first stirring conveyance member and the second stirring conveyance member, and that has a rotation shaft and a spiral blade provided on a peripheral surface of the rotation shaft;

wherein a discharge regulating member that regulates discharge of the developer is provided at a portion within the discharge passage on an upstream side of the developer discharge port in a developer discharge direction;

wherein the discharge regulating member includes a blade diameter enlarging portion wound at least once around an outer peripheral portion of the spiral blade; and wherein a gap between an outer peripheral portion of the blade diameter enlarging portion and an inner peripheral surface of the discharge passage is narrower than a gap between an outer peripheral portion of a portion of the spiral blade that is not provided with the blade diameter enlarging portion and the inner peripheral surface of the discharge passage.

2. The developing device of claim 1, wherein the discharge regulating member is provided in vicinity of the developer discharge port, within the discharge passage.

3. An image forming apparatus comprising the developing device of claim 1.

4. A developing device, comprising:

a developing container that stores therein a developer including a magnetic carrier and a toner, a first stirring conveyance member and a second stirring conveyance member that stir and convey the developer within the developing container; and a developer carrying member that is disposed to face an image carrier on which an electrostatic latent image is formed, that is rotatably supported by the developing container, and that carries the developer supplied from the second stirring conveyance member, wherein the developing container includes a first conveyance chamber where the developer is conveyed by the first stirring conveyance member, a second conveyance chamber where the developer is conveyed by the second stirring conveyance member in a direction opposite to a direction in which the first stirring conveyance member conveys the developer, a partition portion that separates the first conveyance chamber and the second conveyance chamber from each other, communication portions that are provided at both end portions of the partition portion in a longitudinal direction, and through which the first conveyance chamber and the second conveyance chamber communicate with each other, and a discharge passage that is provided to be continuous with a downstream side, in a developer conveyance direction, of one of the first conveyance chamber and the second conveyance chamber, and in which a developer discharge port for discharging surplus developer within the developing container is formed;

wherein, in the discharge passage, there is disposed a discharge screw that is provided to be continuous with an end portion of one of the first stirring conveyance member and the second stirring conveyance member, and that has a rotation shaft and a spiral blade provided on a peripheral surface of the rotation shaft;

wherein a discharge regulating member that regulates discharge of the developer is provided at a portion within the discharge passage on an upstream side of the developer discharge port in a developer discharge direction;

wherein the discharge regulating member includes a ring member provided on the inner peripheral surface of the discharge passage along a circumferential direction of the discharge passage; and wherein a gap between an inner peripheral portion of the ring member and the peripheral surface of the rotation shaft is narrower than a gap between an inner peripheral surface of a portion of the discharge passage that is not provided with the ring member and the peripheral surface of the rotation shaft.

5. The developing device of claim 4, wherein the discharge regulating member is provided in vicinity of the developer discharge port, within the discharge passage.

6. The developing device of claim 4, wherein the gap between the inner peripheral portion of the ring member and the peripheral surface of the rotation shaft is narrower than a distance between an outer peripheral portion of the spiral blade and the peripheral surface of the rotation shaft.

7. The developing device of claim 4, wherein the inner peripheral portion of the ring member is disposed a predetermined distance away from the peripheral surface of the rotation shaft.

8. An image forming apparatus comprising the developing device of claim 4.

9. A developing device, comprising:

a developing container that stores therein a developer including a magnetic carrier and a toner, a first stirring conveyance member and a second stirring conveyance member that stir and convey the developer within the developing container; and a developer carrying member that is disposed to face an image carrier on which an electrostatic latent image is formed, that is rotatably supported by the developing container, and that carries the developer supplied from the second stirring conveyance member, wherein the developing container includes a first conveyance chamber where the developer is conveyed by the first stirring conveyance member, a second conveyance chamber where the developer is conveyed by the second stirring conveyance member in a direction opposite to a direction in which the first stirring conveyance member conveys the developer, a partition portion that separates the first conveyance chamber and the second conveyance chamber from each other, communication portions that are provided at both end portions of the partition portion in a longitudinal direction, and through which the first conveyance chamber and the second conveyance chamber communicate with each other, and a discharge passage that is provided to be continuous with a downstream side, in a developer conveyance direction, of one of the first conveyance chamber and the second conveyance chamber, and in which a developer discharge port for discharging surplus developer within the developing container is formed;

wherein, in the discharge passage, there is disposed a discharge screw that is provided to be continuous with an end portion of one of the first stirring conveyance member and the second stirring conveyance member, and that has a rotation shaft and a spiral blade provided on a peripheral surface of the rotation shaft;

wherein a discharge regulating member that regulates discharge of the developer is provided at a portion within the discharge passage on an upstream side of the developer discharge port in a developer discharge direction;

wherein the discharge regulating member includes a blade diameter enlarging portion wound at least once around an outer peripheral portion of the spiral blade and a ring member provided on an inner peripheral surface of the discharge passage along a circumferential direction of the discharge passage; and wherein a gap between an inner peripheral portion of the ring member and the peripheral surface of the rotation shaft is narrower than a distance between an outer peripheral portion of the blade diameter enlarging portion and the peripheral surface of the rotation shaft.

10. The developing device of claim 9, wherein the discharge regulating member is provided in vicinity of the developer discharge port, within the discharge passage.

11. The developing device of claim 9, wherein the gap between the inner peripheral portion of the ring member and the peripheral surface of the rotation shaft is narrower than a distance between the outer peripheral portion of the spiral blade and the peripheral surface of the rotation shaft.

12. The developing device of claim 9, wherein the inner peripheral portion of the ring member is disposed a predetermined distance away from the peripheral surface of the rotation shaft.

13. An image forming apparatus comprising the developing device of claim 9.

* * * * *